US010415165B2

(12) United States Patent
Lonati et al.

(10) Patent No.: US 10,415,165 B2
(45) Date of Patent: Sep. 17, 2019

(54) OPEN-TYPE CIRCULAR KNITTING MACHINE FOR THE OPEN AND WIDTH-VARIABLE WEB PRODUCTION WITH A KNITTED FABRIC TAKE-DOWN AND/OR COLLECTING ASSEMBLY

(71) Applicant: SANTONI S.P.A., Brescia (IT)

(72) Inventors: Ettore Lonati, Botticino (IT); Fausto Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 221 days.

(21) Appl. No.: 15/513,947

(22) PCT Filed: Sep. 29, 2015

(86) PCT No.: PCT/IB2015/057442
§ 371 (c)(1),
(2) Date: Mar. 23, 2017

(87) PCT Pub. No.: WO2016/055904
PCT Pub. Date: Apr. 14, 2016

(65) Prior Publication Data

US 2017/0268140 A1 Sep. 21, 2017

(30) Foreign Application Priority Data

Oct. 6, 2014 (IT) ..... BS2014A0181

(51) Int. Cl.
*D04B 15/88* (2006.01)
*D04B 9/20* (2006.01)

(52) U.S. Cl.
CPC ..... *D04B 15/88* (2013.01); *D04B 9/20* (2013.01)

(58) Field of Classification Search
CPC ..... D04B 15/88; D04B 9/20
See application file for complete search history.

(56) References Cited

U.S. PATENT DOCUMENTS 5,186,027 A 2/1993 Tenconi
6,029,478 A * 2/2000 Panuccio ..... D04B 15/88 66/149 R (Continued)

FOREIGN PATENT DOCUMENTS

EP 0 893 527 A2 1/1999
GB 343 534 A 2/1931

(Continued)

OTHER PUBLICATIONS

Dec. 21, 2015 International Search Report issued in International Patent Application No. PCT/IB2015/057442.

*Primary Examiner* — Danny Worrell
(74) *Attorney, Agent, or Firm* — Oliff PLC

(57) ABSTRACT

An open-type knitting machine for the open and width-variable web production with a fabric take-down and/or collecting assembly, including a basement and a knitting head provided with a needle-holding element having a plurality of needles arranged around a central axis. A first active needle and a last active needle of the plurality delimit between them a dead zone of the needle-holding element without active needles, and an operating zone shaped as an arc of circle and provided with active needles for producing a partially tubular knitted fabric. A take-down and/or collecting assembly for the knitted fabric under production is arranged downstream from the knitting head with respect to a feeding direction of the knitted fabric. The knit-ting machine further comprises devices for adjusting the angular position of the take-down and/or collecting assembly with respect to the dead zone of the needle-holding element around the central axis.

10 Claims, 12 Drawing Sheets

(56) References Cited

U.S. PATENT DOCUMENTS

| | | | | |
|---|---|---|---|---|
| 7,093,466 | B1 * | 8/2006 | Chen | D04B 15/88 66/153 |
| 2005/0229642 | A1 * | 10/2005 | Lonati | D04B 15/88 66/153 |
| 2008/0283648 | A1 * | 11/2008 | Lonati | D04B 15/88 242/150 R |
| 2015/0211155 | A1 * | 7/2015 | Chen | D04B 15/88 66/151 |

FOREIGN PATENT DOCUMENTS

| | | | |
|---|---|---|---|
| GB | 494 104 | A | 10/1938 |
| WO | 2005/100659 | A1 | 10/2005 |

* cited by examiner

OPEN-TYPE CIRCULAR KNITTING MACHINE FOR THE OPEN AND WIDTH-VARIABLE WEB PRODUCTION WITH A KNITTED FABRIC TAKE-DOWN AND/OR COLLECTING ASSEMBLY

The present invention relates to an open-type circular knitting machine for the open and width-variable web production with a knitted fabric take-down and/or collecting assembly.

Circular knitting machines are equipped with at least a needle-holding element (needle cylinder and/or plate) on which one or more series of needles are arranged along a circular path (circular needlebeds) and with a device apt to control the movement of the needles for knitted fabric formation.

It is known about circular knitting machines in which needles develop along a complete circular path, and which are apt to form tubular knitted fabrics which are then cut—using suitable means which the machine is equipped with—along a longitudinal line, and opened so as to be wound in a single layer onto a roll by means of a knitted fabric take/down and/or collecting assembly. The take-down and/or collecting assembly can spread (or open) the knitted fabric produced by the machine as a cut knitted tube and to collect it in a single layer, typically by winding it onto a roll. The single-layer fabric coming from the needle-holding element and collected by the take-down and/or collecting assembly, is obtained by spreading (or "opening") the tubular knitted fabric that has been cut. In other words, the take-down and/or collecting assembly collects a single-layer fabric (by winding it onto the roll): the single-layer fabric is shaped as a continuous band with a particular length and comes from the machine as a tubular knitted fabric that has been cut and opened. These machines are defined as open-type machines. These machines can sometimes comprise only a collecting assembly, i.e. without the take-down function: this occurs e.g. in machines in which the take-down function is implemented directly on the needlebed. In this case the knitted fabric produced by the needle-holding element gets down to the collecting assembly, which winds it onto a roll, typically by means of a take-up device. In any case, an open-type machine can be defined as a circular knitting machine in which the produced fabric is collected "in an open mode", i.e. a single layer, by winding it onto a collecting roll. Public document WO 2005100659 discloses an open-type circular knitting machine comprising: a supporting frame, a cylinder associated to the supporting frame and to be actuated in rotation around a central axis of rotation at a first angular speed so as to produce a tubular knitted fabric; a take-down and collecting assembly operatively associated to the supporting frame and actuated in rotation around the central axis of rotation at a second angular speed differing from the first one; cutting means operatively associated to the take-down and collecting assembly so as to progressively cut the tubular knitted fabric along a predefined cutting trajectory, wherein the cutting means are integral with the the take-down and collecting assembly and are apt to cut the fabric along an inclined trajectory with respect to the central axis of rotation. The take-down and collecting assembly further comprises spreading apart means provided with two divarication rolls apt to open the cut fabric and a return roll for the open fabric. Both spreading rolls are inclined downwards.

It is further known about open-type circular knitting machines in which the needles develop in series along a path shaped as an arc of circle (less than 360°), and which are apt to form knitted fabrics with a partial or partially tubular circumferential development (fabric production directly in open mode). In other words, the needle cylinder and/or plate of these machines has/have a zone (dead zone) without needles. During fabric formation, these machines rotate continuously and suitable devices allow at every revolution to begin thread feeding on the first needle (of the series shaped as an arc of circle) and to interrupt feeding on the last operating needle. Concerning this, document IT01244605 discloses a circular knitting machine for open fabric production provided with a needle cylinder and with a plate having a section without needles, and with a thread pinching and cutting device arranged near this section. It is further known about circular knitting machines for open fabric production provided with a take-down assembly for fabric under formation. Concerning this, known document EP0893527 discloses a device for taking down knitted fabrics in circular machines for producing tubular fabric with an open development. The device comprises a plurality of tensioning rolls whose axes are arranged in a polygonal shape inside the needle cylinder and can be actuated in an independent manner.

It is further known about circular knitting machines for open-type production (provided with a dead zone), in which the number of active needles and therefore the extension of the arc of circle mentioned above can be varied. It is thus possible to produce fabric with different fabric heights on the same machine. These machines are also known as width-variable web machines. Known width-variable web machines are equipped with devices enabling to vary the number of operating needles reducing—starting from the last needle—the number of active needles on the machine (and thus the extension of the dead zone, of the path shaped as an arc of circle and the height of the produced fabric).

In the framework of open-type circular knitting machines for the open and width-variable web production, the Applicant has observed that the angular position of the fabric under formation with respect to the take-down and/or collecting assembly changes as the number of active needles changes. In particular, if, as described above, the machine allows to vary the number of needles under formation starting from the last needle only, the middle line of the dead zone (meaning the plane of symmetry of the dead zone containing the main axis of the needle cylinder) is not fixed but moves as the active needles vary, as well as the middle line of the path shaped as arc of circle defined by said active needles and therefore the middle line of the fabric under formation.

The Applicant has further observed that this phenomenon affects the take-down and/or collecting operations executed downstream from the fabric formation area, and therefore the quality of the fabric produced. In particular, the Applicant has observed that this phenomenon affects the distribution of the take-down forces in the fabric, and the fabric piling-up modes in the collecting area.

Moreover, the Applicant has noticed that, if the take-down and/or collecting elements have their own symmetry, this symmetry should preferably be maintained also with respect to the fabric under formation so as to ensure the correct execution of the take-down and collecting operations.

Under these circumstances, the aim underlying the present invention in its various aspects and/or embodiments, is to provide an open-type circular knitting machine for the open and width-variable web production that has a better quality than those at the state of the art.

A particular aim of the present invention is to propose an open-type circular knitting machine for the open and width-variable web production that allows to correctly take down the web under formation whatever the number of active needles used and therefore for every web height.

Another aim of the present invention is to propose an open-type circular knitting machine for the open and width-variable web production that allows to correctly collect in a single layer the web under formation whatever the number of active needles used and therefore for every web height.

These and other possible aims, which shall appear better from the following description, are basically achieved by an open-type circular knitting machine for the open and width-variable web production with a fabric take-down and/or collecting assembly according to one or more of the appended claims and according to the following aspects and/or embodiments, variously combined, also with the aforesaid claims.

The claims and the aspects of the present invention, where they relate to an open-type machine for the open and width-variable web production, thus specifically identify a knitting machine having the characteristics described above, which characteristics identify and define this type in a clear and unambiguous manner within the reference field, and can be clearly understood by a skilled technician. The terms used in the claims and in the aspects should therefore be correctly construed in the light of this information about the reference technical field. In particular, the characteristics according to which the machine of the present invention is of the open-type, for the open and width-variable web production, have to be understood as precise technical characteristics, which are limiting and should not be understood as a mere example of a knitting machine, among the large number of existing types, into which machine the other technical characteristics disclosed in the claims and/or in the aspects can be integrated.

Some aspects of the invention are listed below.

In a first aspect, the invention relates to an open-type knitting machine for the open and width-variable web production with a fabric take-down and/or collecting assembly, comprising: a basement; a knitting head mounted onto the basement and comprising: at least a needle-holding element having at least a plurality of needles arranged around a central axis; a first active needle and a last active needle of said plurality delimiting between them a dead zone of the needle-holding element without needles and/or without active needles, and an operating zone shaped as an arc of circle and provided with active needles; control means operatively connected at least to the active needles so as to selectively actuate said active needles in order to produce an open knitted fabric; a take-down and/or collecting assembly for the knitted fabric under production, arranged downstream from the knitting head with respect to a feeding direction of said knitted fabric under production, wherein said take-down and/or collecting assembly is integral with the needle-holding element during the production of the knitted fabric; devices for adjusting the angular position of the take-down and/or collecting assembly with respect to the dead zone of the needle-holding element around the central axis. In other words, the machine according to the invention is provided with a take-down and/or collecting assembly which during fabric production is in a fixed angular position (around the main axis) with respect to the needle-holding element and with respect to the dead zone, though it can be moved (by rotating and blocking it with respect to the needle-holding element) between one manufacturing cycle and the following one when the machine is idle.

In a second aspect, the present invention relates to a take-down and/or collecting set for open-type knitting machines for the open and width-variable web production, comprising: a supporting frame to be firmly connected to the knitting head and/or to the basement of a circular machine; a take-down and/or collecting assembly supported by said supporting frame; devices for adjusting the angular position of the take-down and/or collecting assembly with respect to a needle-holding element of said knitting head. Said take-down and collecting set can be also installed on already existing machines with variable width web so as to improve the quality of the produced fabric (retrofitting).

In a third aspect, the present invention relates to a method for adjusting the width of a knitted fabric produced on an open-type circular knitting machine for the open and width-variable production of the web with a knitted fabric take-down and/or collecting assembly, comprising the steps of: setting the width of a dead zone of a needle-holding element of said machine delimited by a first active needle and by a last active needle of at least a plurality of active needles arranged along an operating zone shaped as an arc of circle developing around a central axis; adjusting the angular position of the take-down and/or collecting assembly of said machine with respect to the dead zone. In other words, the position of the take-down and/or collecting assembly with respect to the needle-holding element is corrected based on the number of needles used for fabric formation and therefore on the position of the fabric under formation.

In a fourth aspect, the present invention relates to a process for producing a fabric on an open-type circular knitting machine for the open and width-variable web production, comprising the method claimed and/or described in one or more of the listed aspects and/or implemented by means of a circular knitting machine claimed in the appended claims and/or described in one or more the listed aspects and/or implemented by means of the take-down and/or collecting set described in one or more of the listed aspects.

The Applicant has then found out that the invention allows to select and set in a precise and repeatable manner the angular position (which then remains unchanged during a manufacturing cycle) of the take-down and/or collecting assembly with respect to the operating zone shaped as an arc of circle provided with active needles, and therefore with respect to the fabric under formation so as to optimize fabric take-down and/or collecting operations and thus ensure product quality. In particular, the Applicant has found out that the invention allows to ensure the correct distribution of the take-down forces on the fabric coming down from the needle-holding element. The Applicant has also found out that the invention allows to collect the formed fabric in an orderly fashion and/or without folds or defects. The Applicant has further found out that the invention allows to select and set said optimized angular position as a function of the number of active needles (and therefore of the width of the dead zone), i.e. of the height of the fabric under formation on the machine.

It should be pointed out again that in the present description and in the appended claims, the term "dead zone" means the zone of the needle-holding element (extending as an arc of circle) that does not take part in fabric formation because it is without needles or because it is provided with inactive needles or because it is partly without needles and partly provided with inactive needles. This dead zone is delimited by the complementary operating zone shaped as an arc of circle and provided with active needles, i.e. needles getting into contact with the threads and taking part in fabric formation.

The circular knitting machines according to the present invention, in their various aspects, can be single needlebed (with only one needle cylinder) or double needlebed (with needle cylinder and needle plate).

The circular knitting machines according to the present invention, in their various aspects, can be of the type with rotating needle-holding element (with non-rotating needle control means and take-down and/or collecting assembly rotating with the needle-holding element during fabric production) or with fixed needle-holding elements (with rotating needle control means and fixed take-down and/or collecting assembly during fabric production).

Further aspects of the invention are listed below.

In one aspect, the take-down and/or collecting assembly is hung below the knitting head.

In one aspect, the take-down and/or collecting assembly is hung to and supported by the needle-holding element. Under these circumstances, adjustment is preferably executed by rotating of a predefined angle the take-down and/or collecting assembly with respect to the knitting head while this assembly preferably remains hung.

In a different aspect, the take-down and/or collecting assembly rests on the ground or on the basement and is firmly connected to the needle-holding element.

In one aspect, if the needle-holding element is of the rotating type, the take-down and collecting assembly is dragged in rotation during fabric production by the rotation of said needle-holding element and rotates integrally with said needle-holding element, i.e. without any relative rotation with respect to said needle-holding element. The motor moving the needle-holding element and the take-down and/or collecting assembly can therefore be one only, thus reducing overall dimensions and costs.

In one aspect, if the needle-holding element is of the fixed type, the take-down and collecting assembly is fixed, i.e. without any relative rotation with respect to said needle-holding element.

In one aspect, the adjusting devices are operatively placed between said take-down and/or collecting assembly and the knitting head. In one aspect, the adjusting devices are operatively placed between said take-down and/or collecting assembly and the basement.

In one aspect, a supporting frame is/can be firmly connected to the knitting head and/or to the basement and supports the take-down and/or collecting assembly. The adjusting devices are integrated into said supporting frame. The set including the take-down and/or collecting assembly and the aforesaid frame can thus be easily mounted and dismounted also on already existing machines.

In one aspect, adjusting the angular position includes: rotating and then blocking said take-down and/or collecting assembly with respect to the needle-holding element and around said central axis.

In one aspect, the adjusting devices are of the manual adjustment type. Position adjustment is made by the manual intervention of an operator, if required by means of dedicated tools.

In one aspect, the adjusting devices comprise at least a motor configured for moving the take-down and/or collecting assembly with respect to the needle-holding element. In this case, adjustment is made by the motor as a result of an operator's command or automatically as a result of other adjustments.

In one aspect, the adjusting devices comprise a control unit, preferably of electronic type, operatively connected to the motor and configured for receiving at least one datum related to said angular position and for controlling the motor accordingly. The operator can e.g. insert an angular value into the control unit by means of input devices (keyboard, touchscreen, mouse, etc.) and the control unit controls the motor so that it moves the take-down and/or collecting assembly accordingly.

In one aspect, the machine comprises devices for varying the number of active needles in the operating zone (and thus the width of the dead zone) so as to adjust the height of the knitted fabric. In one aspect, setting the width of the dead zone comprises: activating or deactivating at least a needle of said plurality of needles starting from the first active needle and/or from the last active needle. In one aspect, setting the width of the dead zone comprises: to push away or to bring closer at least a needle of said plurality of needles from the first active needle and/or from the last active needle. In one aspect, setting the width of the dead zone comprises: dismounting or mounting at least a needle of said plurality of needles from/to the first active needle and/or from/to the last active needle.

In one aspect, the adjusting devices comprise a control unit, preferably of electronic type, configured for receiving at least one datum related to the width of the dead zone and for providing as output the angular position of the take-down and/or collecting assembly or for controlling the motor accordingly and directly adjusting said angular position.

In one aspect, the adjusting devices comprise a control unit, preferably of electronic type, configured for receiving at least one datum related to the height of the knitted fabric, so as to adjust width of the dead zone accordingly by activating or deactivating a given number of needles and for providing as output the angular position of the take-down and/or collecting assembly or for controlling the motor accordingly and directly adjusting said angular position.

In one aspect, the control unit is configured for receiving as input the number of active needles, calculating the correct position of the take-down and/or collecting assembly corresponding to said number of active needles, and for providing as output the angular position of the take-down and/or collecting assembly or for controlling the motor accordingly and directly adjusting said angular position.

The variation of the number of needles can include a variation of the middle line of the dead zone and thus of the operating zone (or of the plane of symmetry of the dead zone where the central axis lies), which can require the adjustment of the angular position. This variation of the middle line is unavoidable if the needles can be activated or deactivated starting from one end only of the dead zone (usually starting from the last needle of the operating zone).

In one aspect, adjusting the angular position comprises angularly centering the take-down and/or collecting assembly of said machine with respect to the dead zone. Since usually though not necessarily the take-down and/or collecting assembly has its own plane of symmetry (where the central axis lies) and since for a correct management of the fabric under formation (take-down and/or collecting) it is necessary for that plane of symmetry to coincide with the middle line of the dead zone, the centering step described above is important during production.

In one aspect, the adjusting devices comprise: a first disc integral with the needle-holding element; a second disc integral with the take-down and/or collecting assembly, wherein the first disc faces the second disc and is coaxial therewith; wherein the first disc is engageable with the second disc in a plurality of angular positions.

In one aspect, said plurality of angular positions consists of a finite number of angular positions (discrete adjustment).

In one aspect, said plurality of angular positions consists of an infinite number of angular positions (continuous adjustment).

In one aspect, the first and the second disc are coaxial with the central axis. In one aspect, the first disc is movable with respect to the second disc between a first adjustment position in which the first disc can rotate with respect to said second disc, and a second operating position in which the first disc is integrally blocked to the second disc. In one aspect, in the first position the first disc is axially spaced apart from the second disc, and in the second position the first disc is associated to the second disc.

In one aspect, the first disc comprises a first toothing and the second disc comprises a second toothing which are engageable with the first toothing. In one aspect, the first disc comprises a first friction surface and the second disc comprises a second friction surface which is engageable against the first friction surface. In one aspect, said friction surfaces comprise composite materials, comprising e.g. aramide, resin, ceramic, aluminum oxide, graphite, carbon.

In one aspect, means are provided for axially moving the first disc with respect to the second disc between the first and the second position. In one aspect, means are provided for rotating the first disc with respect to the second disc. In one aspect, the moving means and/or the rotating means are of the manual operating type (if required by means of tools). In one aspect, the moving means and/or the rotating means are motorized.

In one aspect, the adjustment devices comprise a mechanical drive, preferably a set of gears, e.g. toothed gear/crown gear. In one aspect, the mechanical drive can be actuated manually, e.g. by means of a crank. In one aspect, the mechanical drive is operatively connected to a motor.

The structures of the above aspects are relatively simple and are therefore reliable and cheap, ensuring at the same type a precise, repeatable adjustment.

In one aspect, the take-down and/or collecting assembly comprises collecting devices only.

In one aspect, the take-down and/or collecting assembly comprises take-down devices only.

In one aspect, the take-down and/or collecting assembly comprises both take-down and collecting devices.

In one aspect, the take-down and/or collecting assembly is basically symmetrical with respect to a plane of symmetry containing the central axis.

In one aspect, the take-down and/or collecting assembly comprises spreading devices configured for opening and stretching in a single layer the knitted fabric produced by the knitting head. The formed fabric getting down from the knitting head as a partially open tube gets into contact with the spreading devices and is opened until it lies in a single layer and in a plane.

In one aspect, the spreading devices have a symmetrical pattern with respect to a plane of symmetry containing the central axis. The symmetry of the spreading devices enables to open the fabric with a symmetrical movement (with respect to the open zone of the fabric, i.e. the dead zone of the needle-holding element).

In one aspect, the spreading devices comprise at least a spreading bar. In one aspect, said at least one spreading bar is symmetrical with respect to a plane containing the central axis. In one aspect, the spreading bar has a curved shape. In one aspect, the spreading bar comprises a curved central portion and two rectilinear side portions.

In one aspect, the take-down and/or collecting assembly comprises devices for piling up the stretched fabric.

In one aspect, the piling-up devices comprise at least a collecting roll. In one aspect, the collecting roll has a rectilinear axis. In one aspect, the axis of the collecting roll is orthogonal to the plane of symmetry of the spreading bar. The fabric, preferably after being opened by passing over the spreading bar, is wound as a bobbin and in a single layer onto the collecting roll.

In one aspect, the take-down and/or collecting assembly comprises take-down elements for the produced fabric. In one aspect, the take-down elements comprise at least a take-down roll, preferably at least a pair of take-down rolls. In one aspect, said at least one take-down roll has a rectilinear axis. In one aspect, said at least one take-down roll is parallel to the collecting roll.

In one aspect, the piling-up devices and the spreading devices, and if necessary the take-down elements, are integral with each other during adjustment.

Further characteristics and advantages shall be more evident from the detailed description of some embodiments, among which also a preferred embodiment, which are exemplary though not exclusive, of an open-type circular knitting machine for the open and width-variable production of the web with a knitted fabric take-down and/or collecting assembly, of a take-down and/or collecting set for open-type circular knitting machines for the open and width-variable production of the web, of a method for adjusting the width of a knitted fabric produced on an open-type circular knitting machine for the open and width-variable production of the web with a knitted fabric take-down and/or collecting assembly, and of a process for producing a fabric on an open-type circular knitting machine for the open and width-variable web production according to the present invention.

This description shall be made below with reference to the accompanying drawings, provided to a merely indicative and therefore non-limiting purpose, in which.

Figure 3:
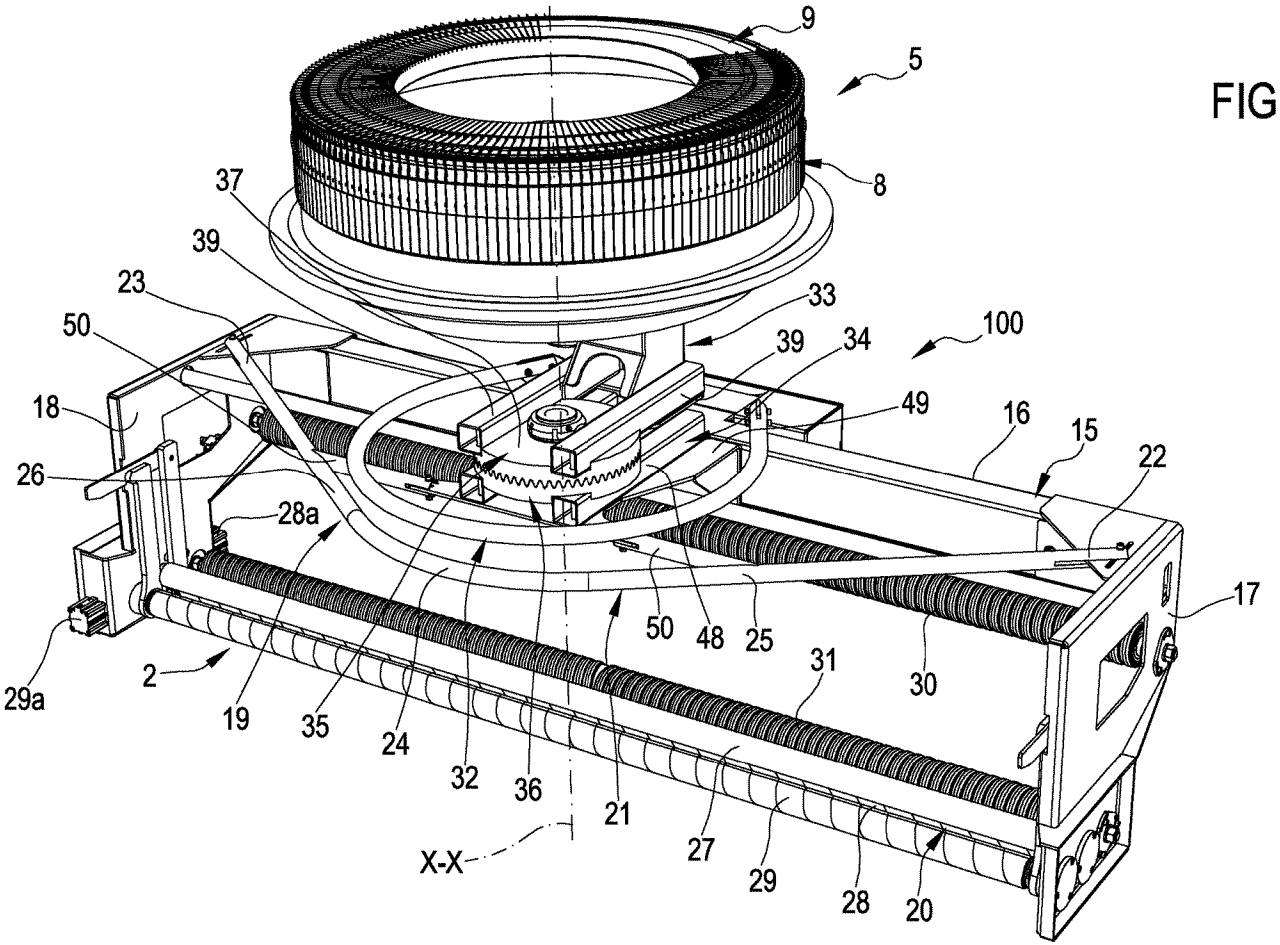
FIG. 3 shows a perspective view of a collecting set associated to a needle-holding element, both belonging to the machine of FIG. 1.
Figure 4:
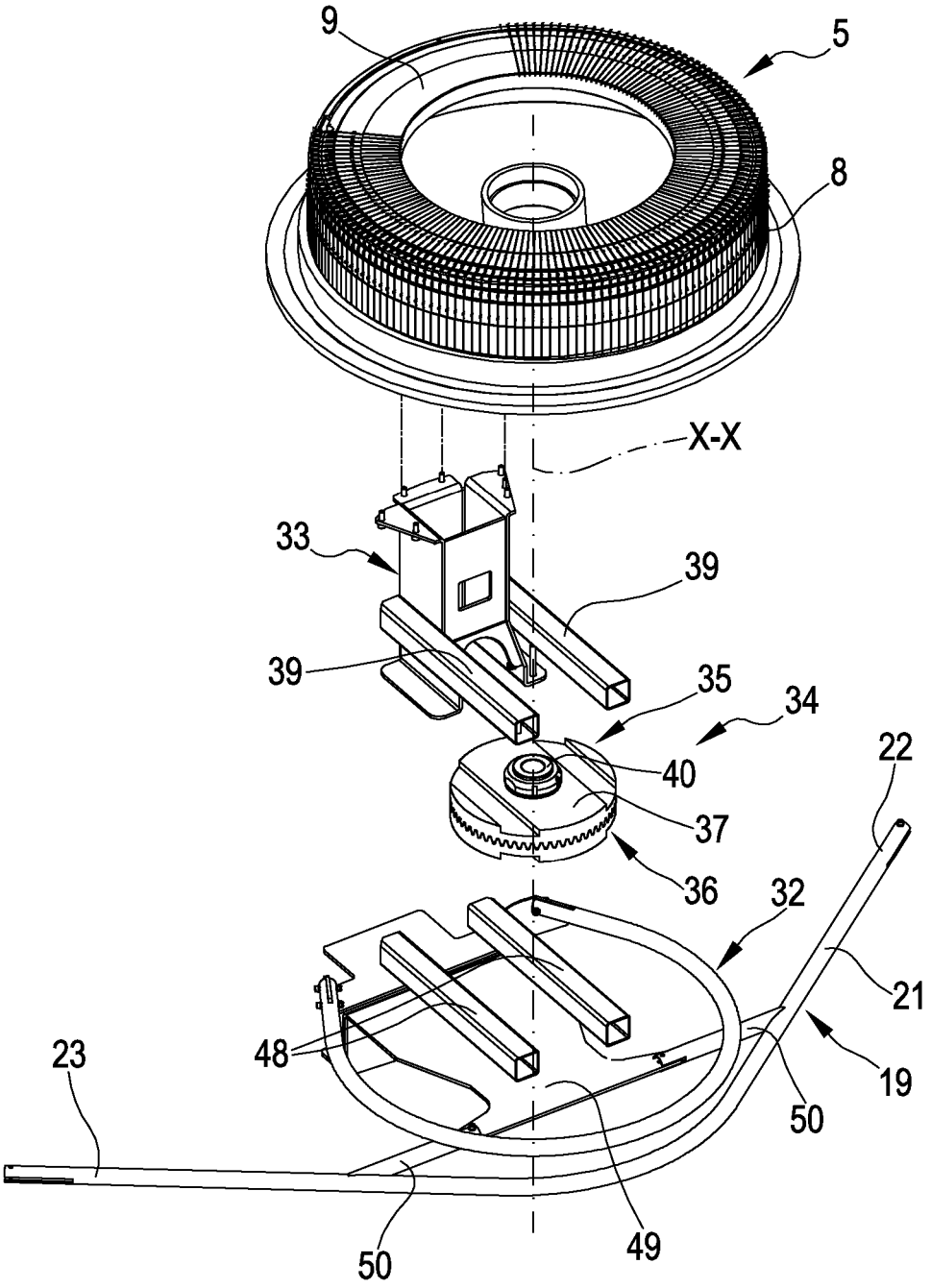
FIG. 4 shows an exploded view of a portion of the set of FIG. 3.
Figure 8:
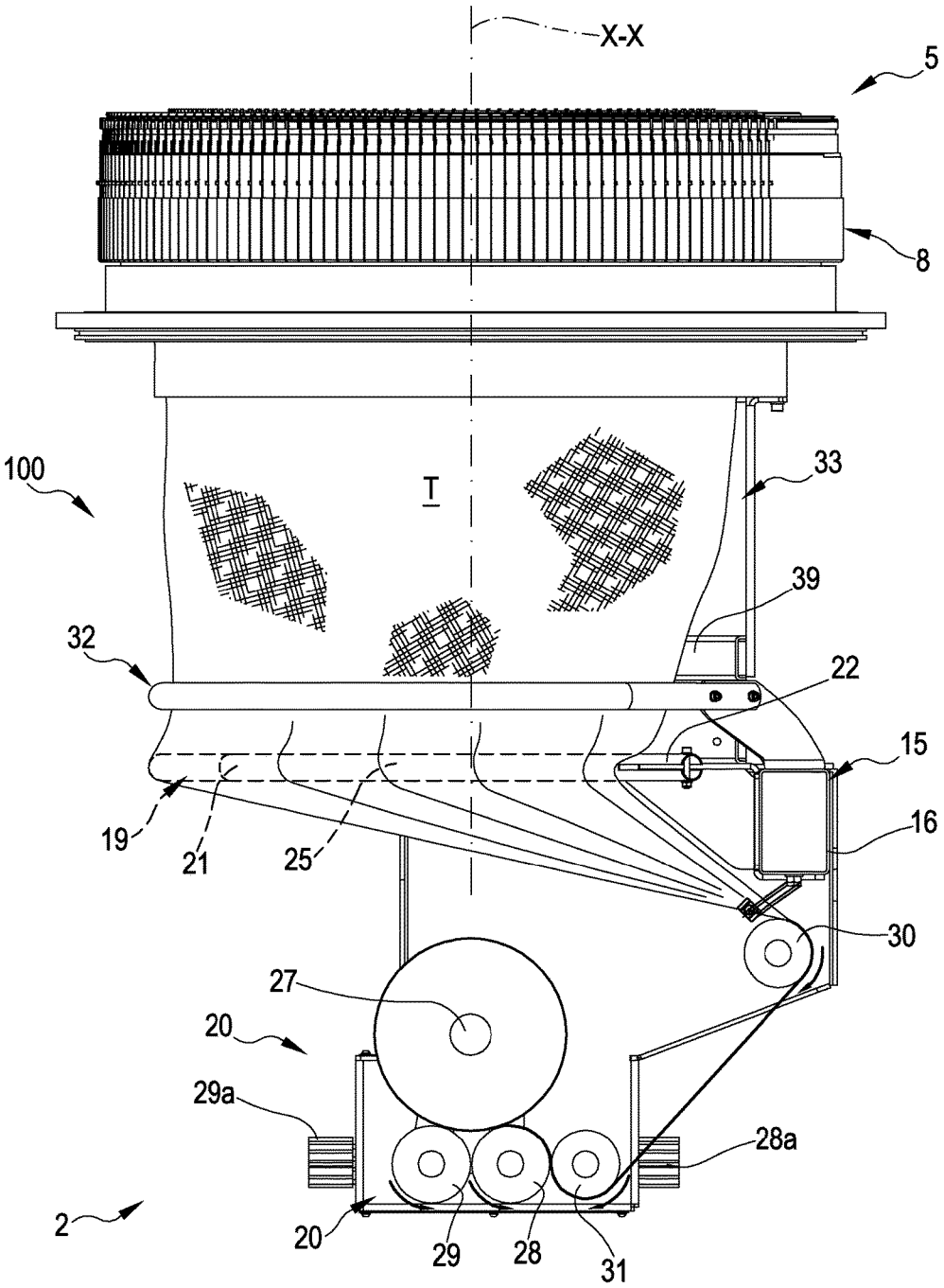
FIG. 8 is a side view of the set as in FIGS. 2 and 3 with some parts removed for better showing others.
Figure 9:
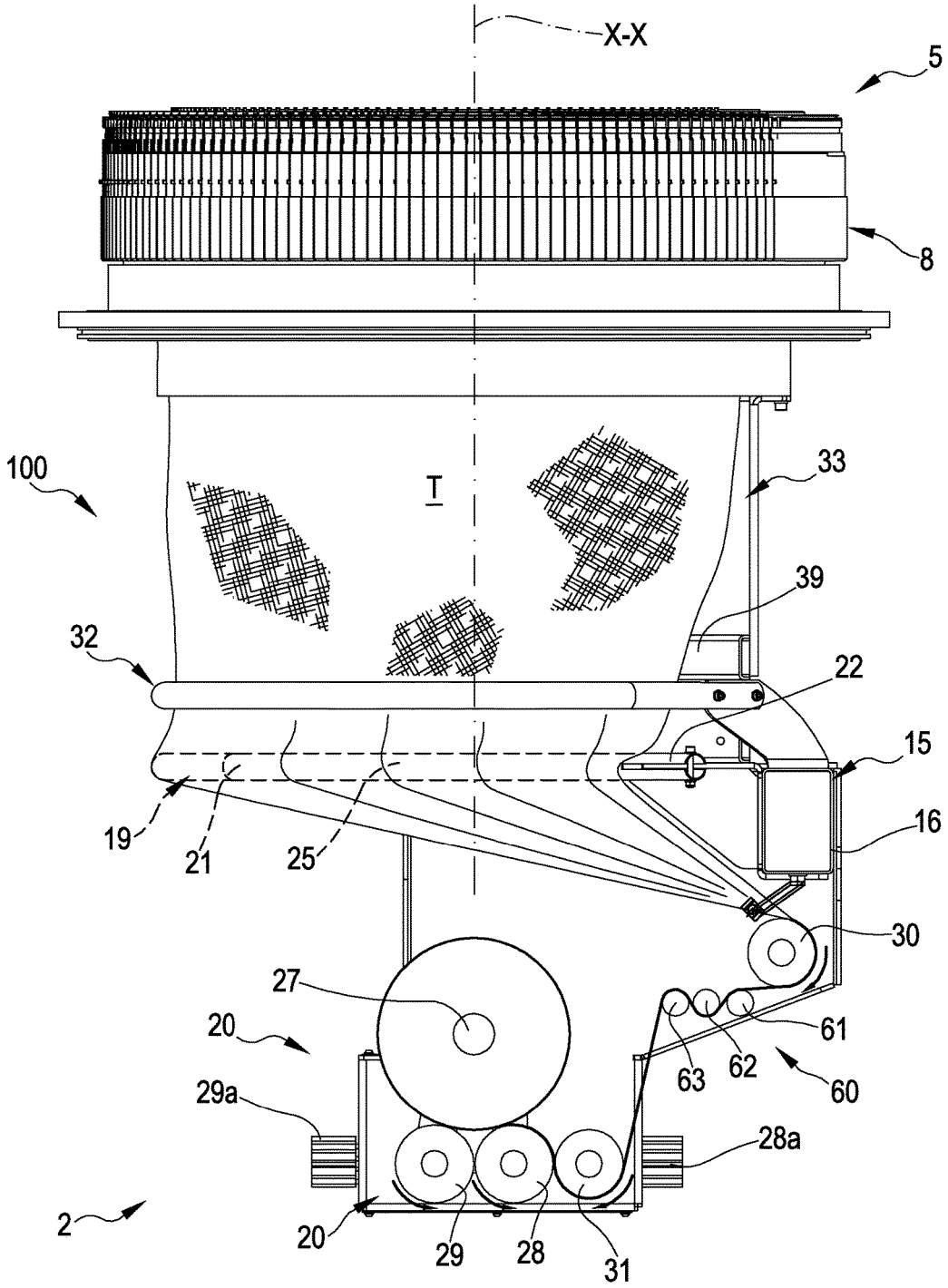
Figure 10:
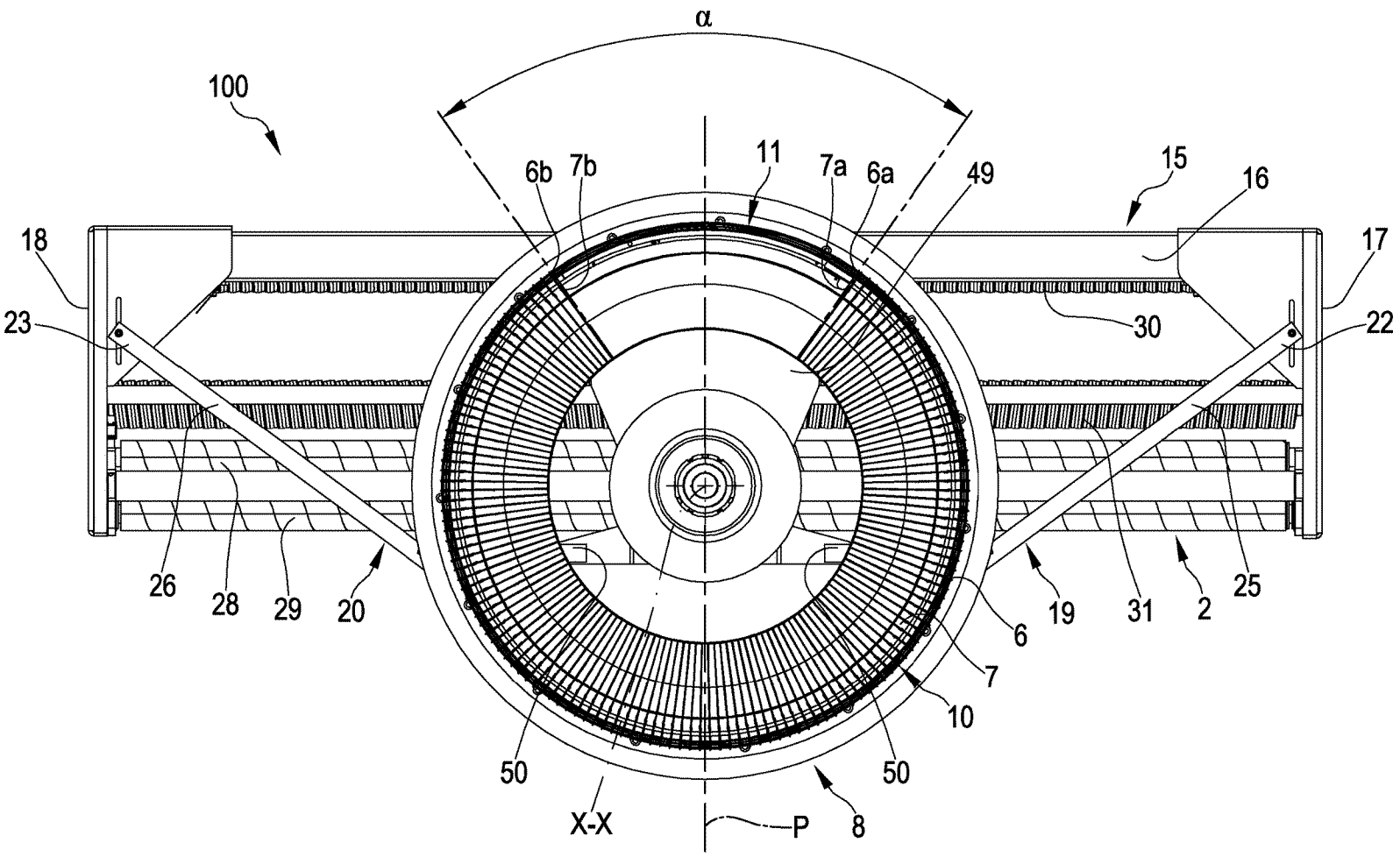
Figure 11:
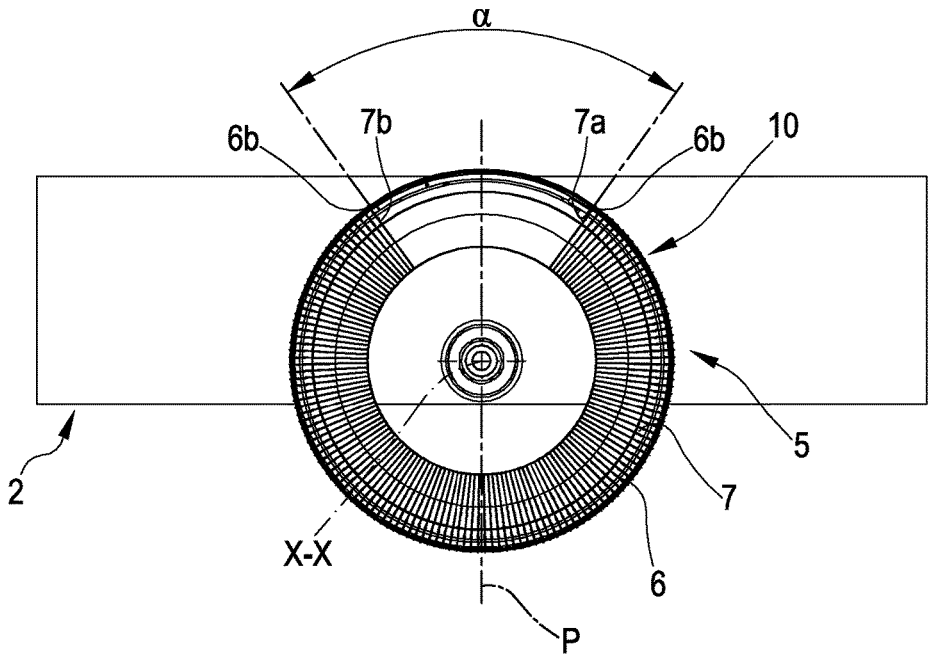
Figure 12:
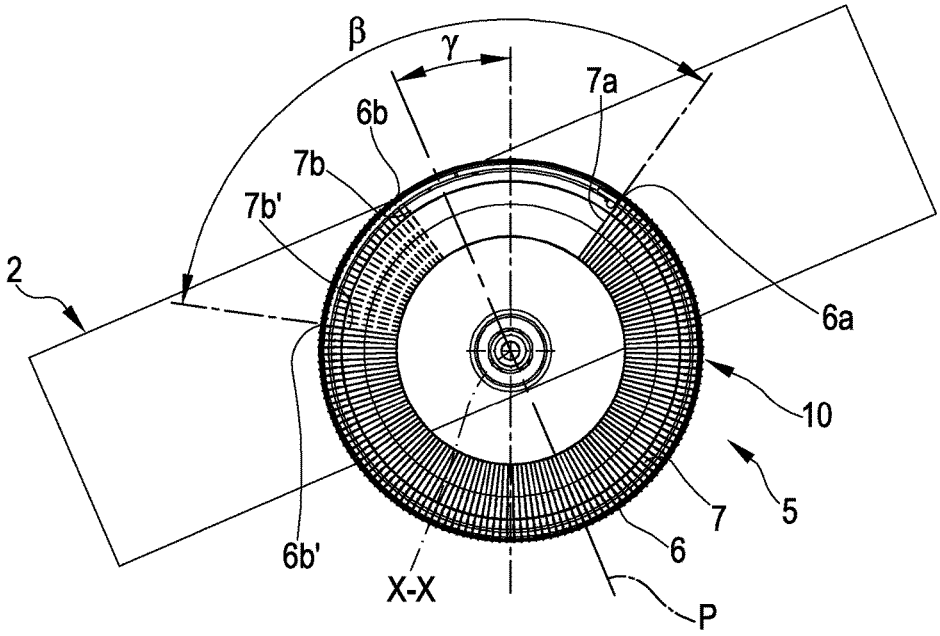
Figure 13:
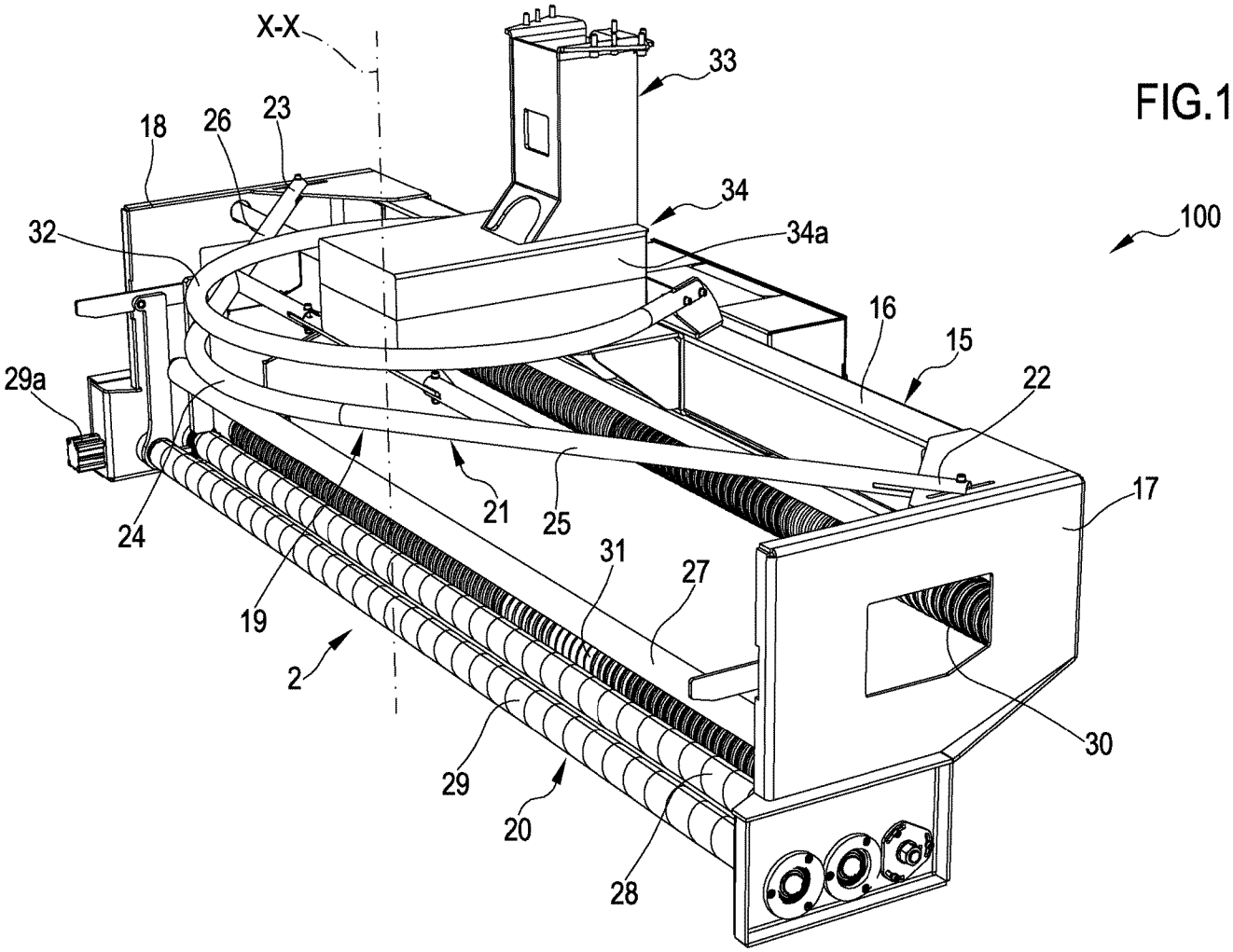

FIG. 9 schematically shows the view of FIG. 8 in accordance with a variant of embodiment of the collecting set;

FIG. 10 is a top view of the set as in FIG. 3;

FIGS. 11 and 12 schematically show the view of FIG. 10 with the set in respective operating positions;

FIG. 13 shows a perspective view of a variant of embodiment of the set of FIG. 3.

With reference to the figures mentioned above, numeral 1 globally refers to an open-type circular knitting machine for the open and width-variable web production with a knitted fabric take-down and/or collecting assembly 2, according to the present invention. A take-down and/or collecting set, comprising this take-down and/or collecting assembly, is globally referred to with numeral 100. In FIGS. 1, 3, 7, 8, 10 and 13 the take-down and/or collecting assembly 2 and set 100 perform a collecting function only, since take-down elements are absent. In FIG. 9 the assembly 2 schematically shown is a take-down and collecting assembly, since it is provided with take-down elements 60, too. In the examples disclosed below, assemblies performing the take-down function only are not detailed, though they belong to the scope of the present invention.

The circular knitting machine 1 comprises (FIG. 1) a basement 3, which is the supporting structure of the machine 1, and a knitting head 4 mounted onto the basement 3 and provided with a needle-holding element 5, with a plurality of needles 6, 7 movably mounted to the needle-holding element (5), with control means (not shown since of known type, e.g. control cams) apt to selectively actuate the plurality of needles so as to enable the production of a knitted fabric "T". The machine 1 shown is of the type with rotating needle-holding element 5 and non-rotating control means.

Figure 1:
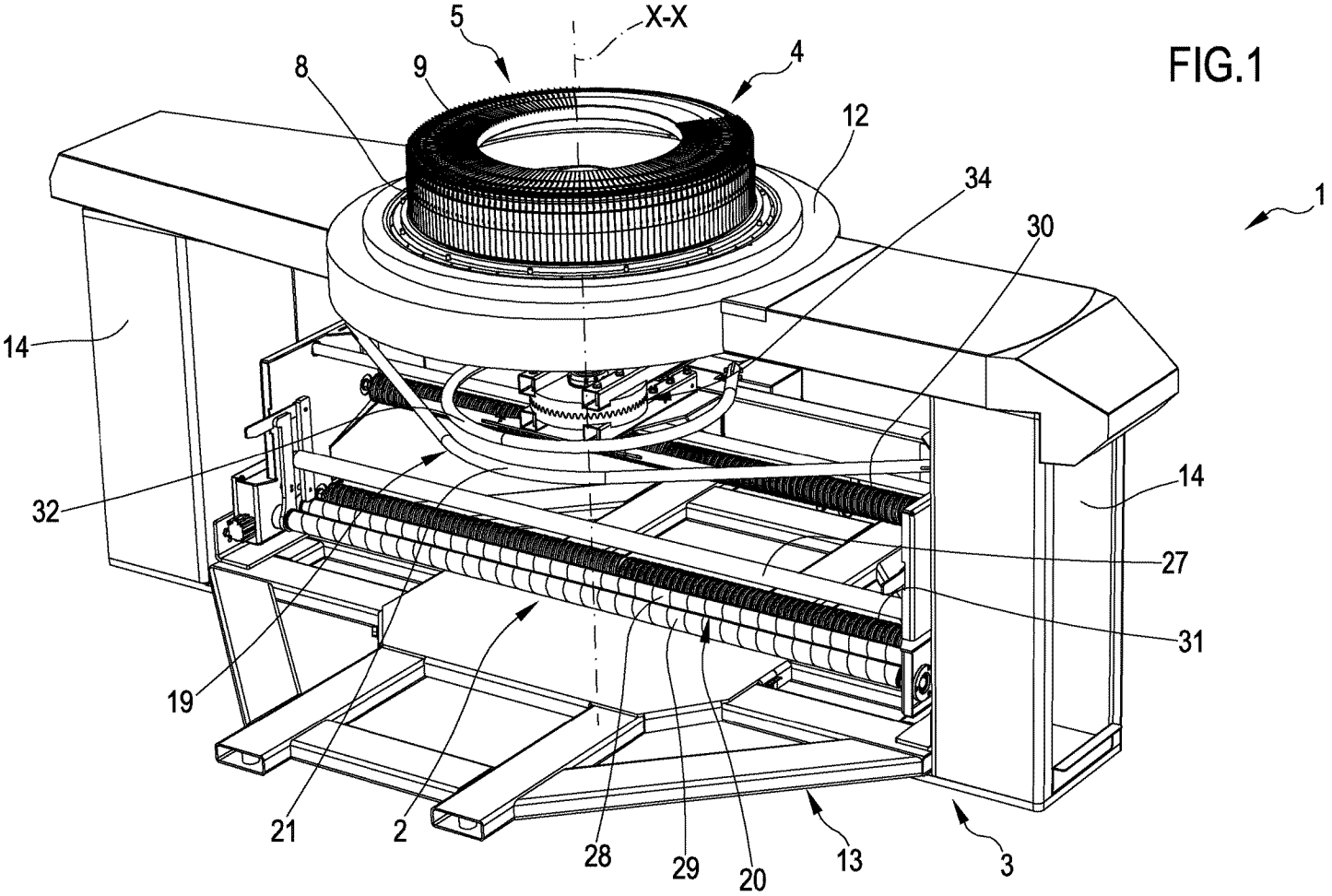
FIG. 1 shows an open-type circular knitting machine for the open and width-variable web production with a knitted fabric take-down and/or collecting assembly according to the present invention.
Figure 2:
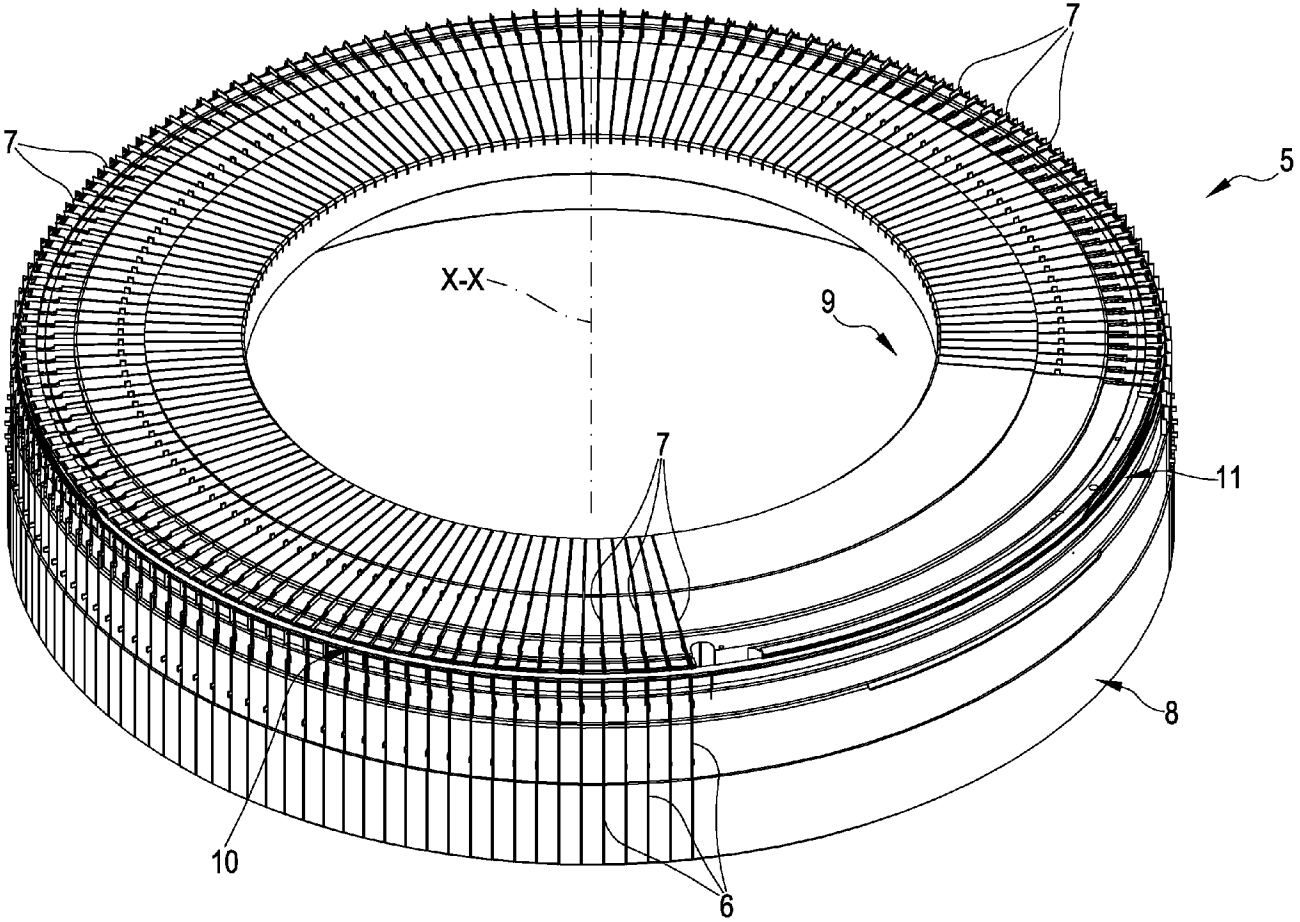
FIG. 2 shows a magnified view of a portion of the machine of FIG. 1.

As better shown in FIG. 2, the needle-holding element 5 comprises a needle cylinder 8 provided with a first plurality of needles 6 having terminal ends placed on an upper edge of the needle cylinder 8. The needle-holding element 5 further comprises a needle plate 9 provided with a second plurality of needles 7 having terminal ends placed on a radially peripheral edge of said plate 9. Said terminal ends of the needles 6, 7 are directed towards an operating zone 10 (FIG. 2) in which occurs the formation of the knitted fabric "T", which then gets down into the needle cylinder 8.

The machine 1 shown according to the invention is of the type for the open and width-variable web production. As a matter of fact, the needles 6, 7 are arranged in series on the needle-holding element 5 (in particular on the needle cylinder 8 and on the needle plate 9) along respect paths shaped as an arc of circle smaller than 360°, as can be seen schematically in FIGS. 10, 11 and 12. In other words, the operating zone 10 is an arc of circle. A first needle 6*a* and a last needle 6*b* of the first plurality of needles 6 delimit in between a zone 11 without needles. In the embodiment shown (FIG. 10), this zone 11 without needles develop on angle "a" of about 40°. Similarly, a first needle 7*a* and a last needle 7*b* of the second plurality of needles 7 of the needle plate 9 delimit in between a zone without needles placed on the zone 11 without needles of the needle cylinder 8. The whole circumference of the needle-holding element 5 is therefore divided into the operating zone 10 shaped as an arc of circle, in which the knitted fabric "T" is formed, and into a complementary zone 11, known as "dead zone", in which the fabric knitted "T" is not formed. The knitted fabric "T" thus formed therefore has the shape of a cylinder with a partial circumferential development, i.e. open on the dead zone.

The machine 1 further comprises devices (known per se and not shown) for varying the number of active needles 6, 7 both of the needle cylinder 8 and of the needle plate 9 so as to widen the dead zone 11 and thus reduce the operating zone 10 and vary in this manner the height of the knitted fabric "T" produced. The needles 6, 7 can be made inactive, e.g. not actuating them and/or moving them away from the operating zone 10 and/or dismounting them. The needles 6, 7 can be made inactive starting from the last needle 6*b* (FIGS. 10, 11 and 12). In FIG. 11, the dead zone has a width "a" and the knitted fabric "T" is thus formed on the operating zone 10 defined by the arc of circle between the last needle 6*b*, 7*b* and the first needle 6*a*, 7*a*. In the example shown in FIG. 12, the dead zone, which in FIG. 11 has a width "α", is widened by reducing the number of active needles starting from the last needle 6*b*, until a width "β" is achieved (FIG. 12). In FIG. 12 the last active needle 6*b*' is no longer the last needle 6*b* close to the zone without needles 11. All the needles 6 between the one referred to with numeral 6*b*' and the last one 6*b* are made inactive. The knitted fabric "T" is thus formed on the operating zone 10 defined by the arc of circle between the last active needle 6*b*', 7*b*' and the first needle 6*a*, 7*a*.

During the formation of the knitted fabric "T", the needle-holding element 5 of the machine 1 rotates continuously around a central axis "X-X" and suitable devices (known per se and not shown) allow at at each revolution to begin thread feeding on the first active needles 6*a*, 7*a* (of the operating zone 10) and to interrupt feeding on the last active needle (6*b* or 6*b*').

The basement 3 comprises an upper ring or supporting element 12 (FIGS. 1 and 2), onto which the knitting head 4 is mounted so that the needle-holding element 5 can rotated with respect to said upper supporting element 12 around said central axis "X-X" and comprises a lower base 13, or cross joint, designed to be laid onto the ground. The upper supporting element 12 and the needle-holding element 5 are coaxial with the central axis "X-X". The basement 3 further comprises two supporting legs 14. A motor, not shown, moves in rotation the needle-holding element 5.

Between the upper ring 12 and the lower base 13 a collecting space without elements of the basement 3 is defined, which is designed to house the collecting assembly 2 for the fabric produced by the machine 1.

The collecting assembly 2 shown is hung to the needle-holding element 5 and supported by the latter. During the production of the knitted fabric "T" it rotates integrally with the needle-holding element 5 in the collecting space. In other embodiments, not shown, the take-down and/or collecting assembly 2 is not hung to but rests on the ground or the basement 3 and is anyhow operatively connected to the needle-holding element 5 so as to rotate integrally with the latter during production.

The collecting assembly 2 shown (which can be seen better in FIGS. 3, 7, 8 and 10) comprises a supporting structure 15 defined by a beam 16 and by two side plates 17, 19 developing from opposite ends of the beam 16 and orthogonal thereto. The side plates 17, 18 are parallel and face each other. The beam 16 develops perpendicular to the central axis "X-X". The collecting assembly 2 is symmetrical with respect to a plane of symmetry "P" (FIGS. 10, 11 and 12) containing the central axis "X-X".

The supporting structure 15 supports spreading devices 19 configured for opening and stretching in a single layer the knitted fabric "T" produced by the knitting head 4, and devices for piling up 20 the knitted fabric "T" once stretched.

The spreading devices 19 (FIGS. 3, 8 and 9) comprise a spreading bar 21 mounted, preferably in a fixed manner, onto the supporting structure 15 and configured for causing two side edges of the knitted fabric "T" to open by progressively moving away from each other. The spreading bar 21 extends longitudinally between two of its terminal ends 22, 23, each one being firmly connected to a respective side plate 17, 18, of the supporting structure 15. The spreading bar 21 is placed opposite the beam 16 and basically extends on the whole length of said beam 16. The spreading bar 21 shown has a curved shape defined by a central portion 24 and by two side portions 25, 26. The two side portions 25, 26 progressively move away from the beam 16 and converge towards the central portion 24, which has a maximum distance from the beam 16 and is apt to guide a central portion of the knitted fabric "T" when coming down. The spreading bar 21 has global shape as a rounded "V", i.e. its central portion 24 is curved, e.g. as an arc of circle, and its two portions 25, 26 are rectilinear. The spreading bar 21 is basically symmetrical with respect to a vertical plane of symmetry "P" containing the central axis "X-X" of the needle-holding element 5 and is arranged in a horizontal plane. The spreading bar 21 is mounted onto the supporting structure 15, e.g. by means of slides placed and the terminal ends 22, 23, so as to adjust the distance of the central portion 24 from the beam 16.

The supporting structure 15 also supports the devices for piling up 20 the knitted fabric "T" stretched, which are placed below the spreading devices 19, i.e. downstream from the spreading devices 19 with respect to a feeding direction of the knitted fabric "T" coming from the knitting head 4. The piling-up devices 19 are defined by a collecting roll 27 (or fabric roller) with rectilinear axis (FIGS. 1, 3, 8, 9). The collecting roll 27 is turnably mounted onto the supporting structure 15 so as to freely rotate around a respective, basically horizontal axis of rotation. The collecting roll 27 is designed to collect the knitted fabric "T" produced by the machine 1 as a bobbin, winding it thereon and in a single continuous layer. The collecting roll 27 extends between two of its terminal ends, on which it is turnably connected to the aforesaid side plates 17 and 18. The axis of rotation of the collecting roll 27 is oriented parallel to the longitudinal development of the beam 16, i.e. orthogonal to the plane of symmetry of the spreading bar 21.

The piling-up devices 20 comprise a first and a second winding roller 28, 29 turnably mounted onto the supporting structure 15 so as to rotate around respective axes of rotation that are basically horizontal and moved in rotation by respective motors 28*a*, 29*a* (FIGS. 3, 8 and 13). The winding rolls 29 extend between two of their longitudinal ends, on which they are turnably connected to the aforesaid side plates 17 and 18. The axes of rotation of the winding rolls 28, 29 are oriented parallel to the longitudinal development of the beam 16. The first and the second winding roll 28, 29 are placed below the collecting roll 27 and both act along respective contact lines upon the fabric wound as a bobbin onto the collecting roll so as to impart a rotation thereto and cause the knitted fabric "T" to be continuously wound onto the collecting roll 27. The winding rolls 28, 29 cannot move whereas the collecting roll 27 is free to vertically move on dedicated guides. The collecting roll 27 rests on the winding rolls 28, 29 and, while collecting the fabric produced as the bobbin diameters increases, vertically moves within the guides.

The collecting assembly 2 comprises a first unfolding roll 30 configured for interacting with the knitted fabric "T" moving towards the collecting roll 27 so as to stretch it horizontally by spreading it towards two side ends of the first unfolding roll 30. The first unfolding roll 30 is mounted above the winding rolls 28, 29 and is placed close to the beam 16. The first unfolding roll 30 is turnably mounted onto the supporting structure 15 so as to freely rotate around a respective, basically horizontal axis of rotation. The first unfolding roll 30 extends between two of its terminal ends, on which it is turnably connected to the aforesaid side plates 17 and 18. The axis of rotation of the the first unfolding roll 30 is oriented parallel to the longitudinal development of the beam 16. With reference to the path of the knitted fabric "T" during production, the first unfolding roll 30 is placed downstream from the spreading bar 21 and upstream from the winding rolls 28, 29.

A second unfolding roll 31 is positioned close to the first winding roll 28. The second unfolding roll 31 is turnably mounted onto the supporting structure 15 so as to freely rotate around a respective, basically horizontal axis of rotation. The second unfolding roll 31 extends between two of its terminal ends, on which it is turnably connected to the aforesaid side plates 17 and 18. The axis of rotation of the the second unfolding roll 31 is oriented parallel to the longitudinal development of the beam 16. With reference to the path of the knitted fabric "T" during production, the second unfolding roll 31 is placed downstream from the first unfolding roll 30 and upstream from the winding rolls 28, 29.

The collecting assembly 2 further comprises a guiding ring 32 mounted, preferably in a fixed manner, onto the supporting structure 15 above the spreading bar 21. The guiding ring 32 is arranged in a basically horizontal plane and is configured for guiding the knitted fabric "T" produced by the machine 1 when coming down directly as a single layer from the needle-holding element 5, towards the spreading bar 21. The guiding ring 32 delimits inwardly a passage in which said knitted fabric "T" gets down, sliding on a radially inner surface of said guiding ring 32. The guiding ring 32 is apt to guide and unfold the knitted fabric "T". The guiding ring 32 laterally extend from the same front side of the beam 16 from which also the spreading bar 21 laterally extends, and it partially overlaps said spreading bar 21. The guiding ring 32 has a basically circular shape and is basically coaxial with the needle-holding element 5. The guiding ring 32 is fixed on a central portion of the beam 16. In the embodiment shown, the guiding ring 32 does not define a complete circle but is formed by a curved bar whose ends are firmly connected to the beam 16.

The knitted fabric "T", coming from the operating zone 10 of the needle-holding element 5, gets down into the needle-holding element 8 shaped as an incomplete tube, through the guiding ring 32 as an incomplete tube and then outside the spreading bar 21 opening and unfolding itself. Then the knitted fabric "T", now completely open in a single layer, is partially wound onto the first unfolding roll 30 and reaches the second unfolding roll 31 onto which it is partially wound by getting below the latter. Eventually, the knitted fabric "T" is wound as a bobbin onto the collecting roll 27 thanks to the rotation of the winding rolls 28, 29.

A supporting frame 33 is firmly connected to the supporting structure 15 and connects the collecting assembly 2 to the needle-holding element 5, in particular with the needle cylinder 8 (FIGS. 3, 4, 7, 8, 13). In the embodiment shown, the supporting frame 33 has a box-shaped structure removably joined to the needle cylinder 8, e.g. by means of screws or bolts, or welded thereto.

Between the supporting frame 33 and the supporting structure 15 of the collecting assembly 2 are operatively placed devices 34 for adjusting the angular position of the collecting assembly 2 with respect to the needle-holding element 5 around the central axis "X-X" (FIGS. 1, 3, 4, 5, 6, 7, 8, 13).

The adjusting devices 34 shown in the embodiment of FIGS. 1 to 12 comprise a first disc 35 firmly connected to the supporting frame 33, and a second disc 36 firmly connected to the supporting structure 15 of the collecting assembly 2. The first disc 35 and the second disc 36 are coaxial with the central axis "X-X".

Figure 5:
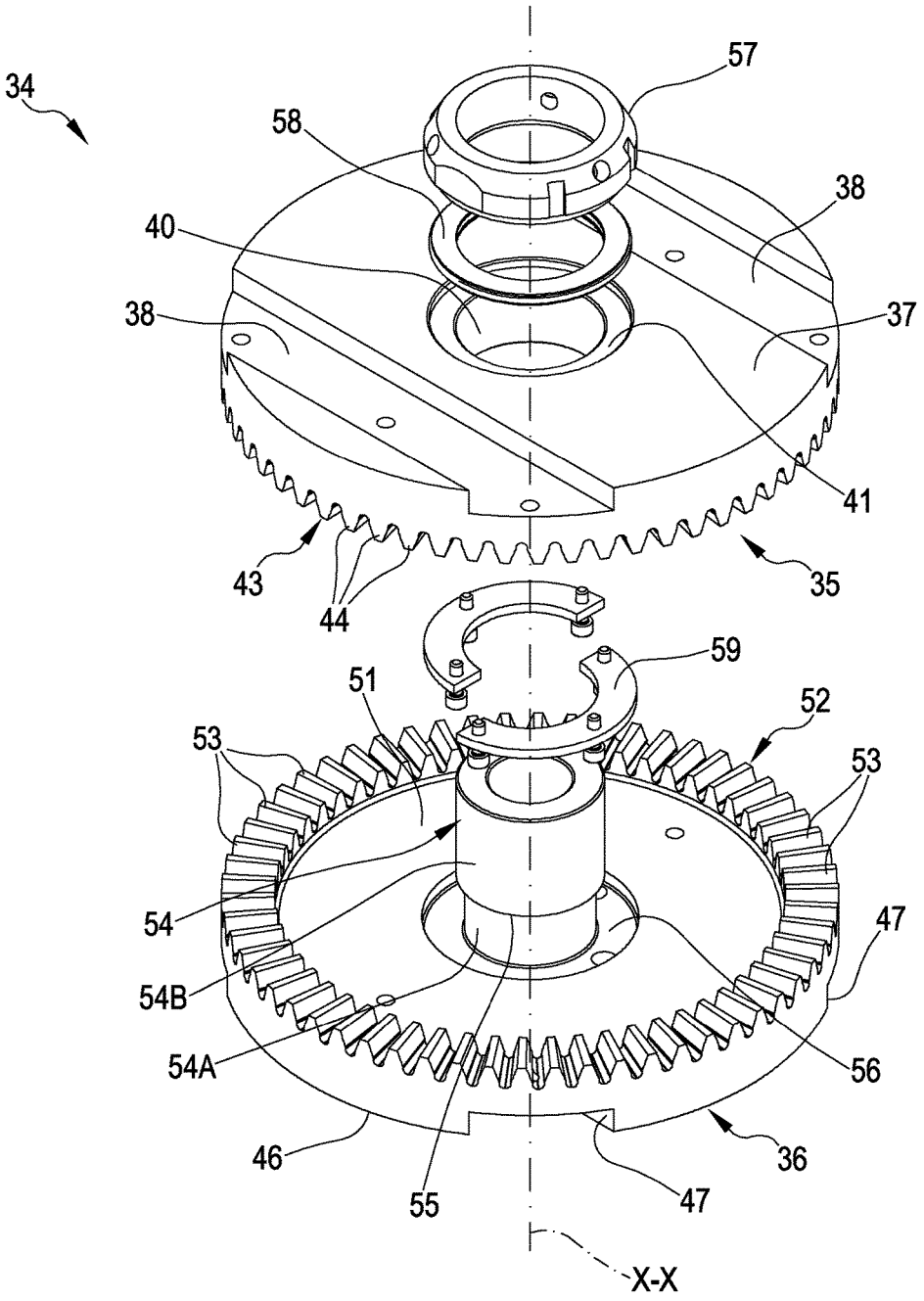
FIG. 5 shows an exploded view of a detail of the set of FIGS. 3 and 4.
Figure 6:
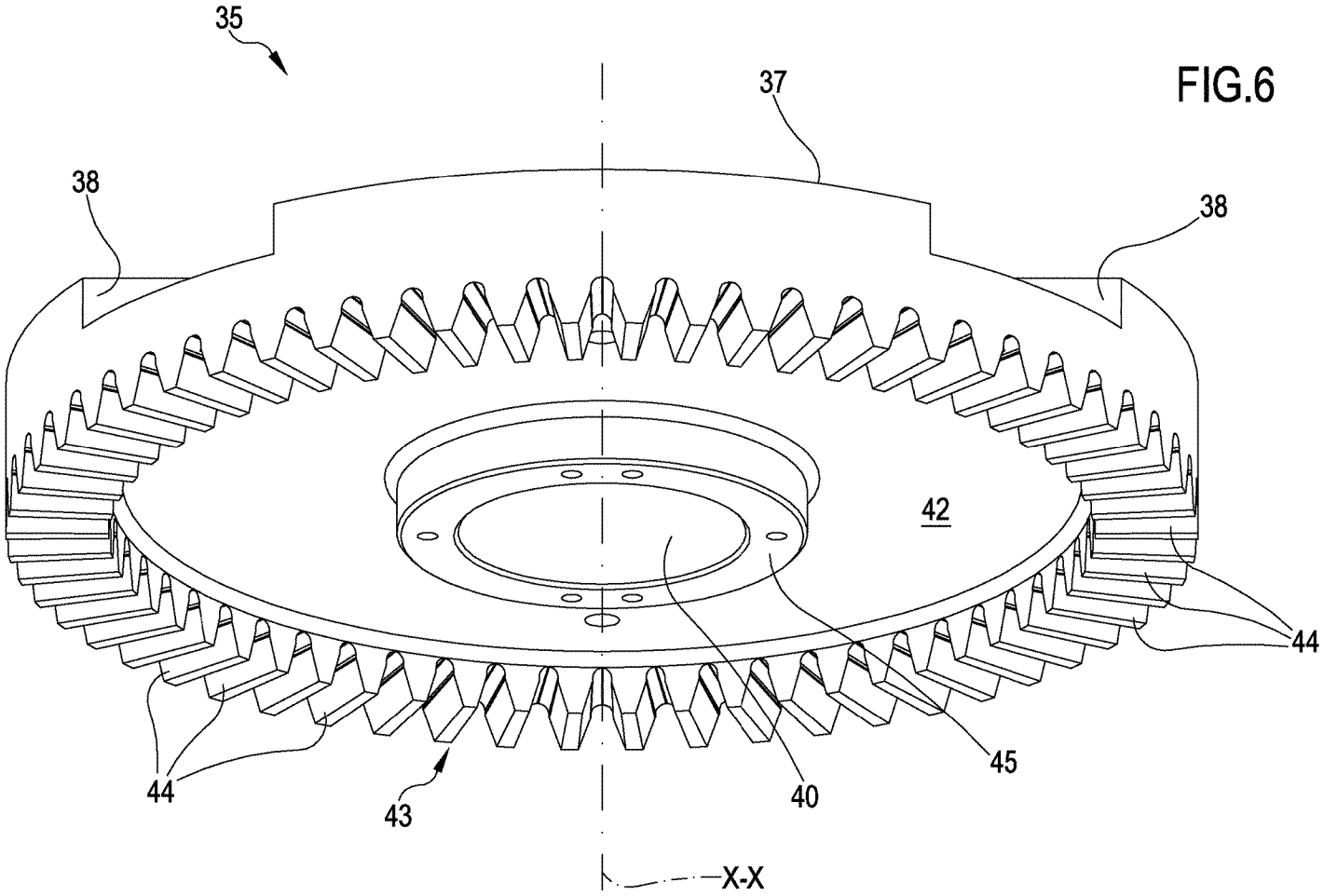
FIG. 6 shows an element of the detail of FIG. 5 from a different point of view.
Figure 7:
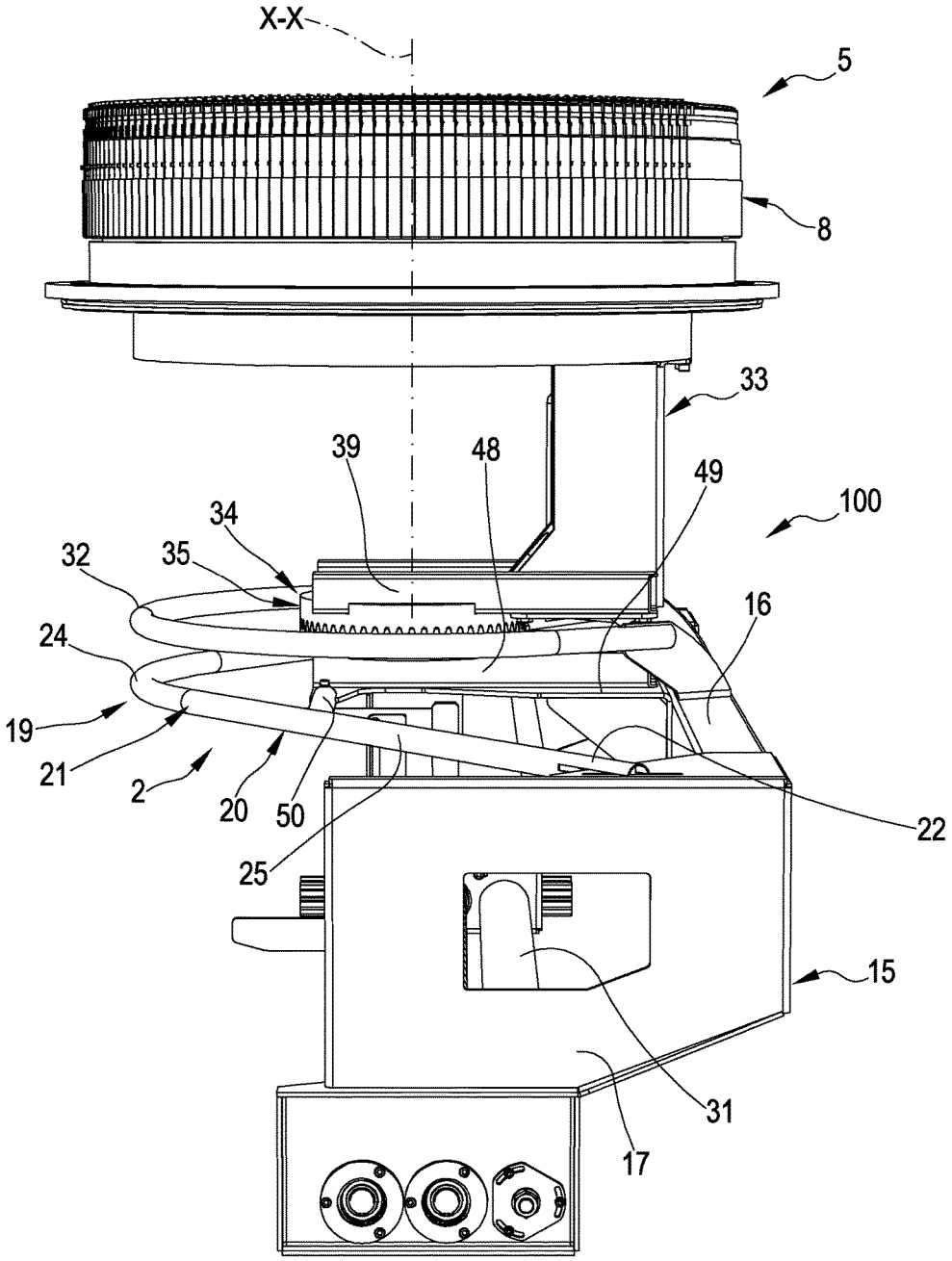
FIG. 7 is a side view of the set as in FIGS. 2 and 3.

The first disc 35 (FIGS. 3, 4, 5 and 6) has a first upper face 37 provided with a pair of first grooves 38, each being apt to house a first supporting bar 39 firmly connected to the supporting frame 33. The first supporting bars 39 are joined, e.g. by means of screws or bolts, to the supporting frame 33 and develop parallel and horizontal on opposite sides of said supporting frame 33. The supporting bars 39 are further joined to the first disc 35 e.g. by means of screws inserted into suitable holes made in the first face 37. The first disc 35 has a central through hole 40 and an annular hollow 41 obtained on the first face 37 around said through hole 40 (FIG. 5). The grooves 38 are rectilinear and parallel and lie on opposite sides of the central through hole 40. A second face 42 of the first disc 35, opposite the first face 37, has a first toothing 43 arranged close to a radially peripheral edge of the second face 42. The first toothing 43 comprises a plurality of teeth 44 arranged in series along a circular path (FIG. 6). Each of the teeth 44 of said first toothing 43 develops away from said second face 42, along an axial direction. An annular projection 45 is further arranged on the second face 42 and around the central through hole 40.

The second disc 36 has a first lower face 46 provided with a pair of second grooves 47 (which can be partially seen in FIG. 5), each being apt to house a second supporting bar 48 (FIGS. 3 and 4) which is in its turn firmly joined to the supporting structure 15. In the embodiment shown, the second supporting bars 48 are joined to a plate 49 which is in its turn joined to the beam 16. In particular, the plate 49 develops projecting from the front side of the beam 16 and is further supported by a pair of reinforcing bars 50 connected to the spreading bar 21. The second supporting bars 48 are parallel to each other and to the first supporting bars 39. The second supporting bars 48 are further joined to the second disc 36, e.g. by means of screws inserted into suitable holes made in the second face 42. A second face 51 of the second disc 36 (FIG. 5), opposite the first face 46, has a second toothing 52 arranged close to a radially peripheral edge of the second face 51. The second toothing 52 comprises a plurality of teeth 53 arranged in series along a circular path. Each of the teeth 53 of said second toothing 52 develops away from said second face 51, along an axial direction. A central shaft 54 develops axially from the second face 51 coaxial with the second toothing 52. The central shaft 54 has a base portion 54A with a smaller diameter and an end portion 54B with a greater diameter so as to define an annular retaining surface 55 directed towards the second face 51. Moreover, an annular groove 56 is defined in the second face 51 and around the base of the central shaft 54.

The first disc 35 and the second disc 36 face each other and are coaxial. In particular, the second face 42 of the first disc 35 faces the second face 51 of the second disc 36. The central shaft 54 of the second disc 36 is inserted into the central through hole 40 of the first disc 35 and the end portion 54B partially protrudes from the first face 37 of said first disc 35. A ring nut 57 with a thrust block 58 is screwed onto the end portion 54B. The thrust block 58 is housed inside the annular hollow 41. Moreover, a retaining ring 59 (in two pieces in the construction solution shown) is mounted around the base portion 54A of the central shaft 54, so as to slide axially onto said base portion 54A, and is joined, e.g. by means of screws, to the annular projection 45 of the first disc 35. A portion of the retaining ring 59 faces the annular retaining surface 55 of the second disc 36.

As can be better seen in FIG. 3, the supporting frame 33, the adjusting devices 34, the first and second bars 39, 48 and the plate 49 are substantially placed inside the guiding ring 32.

The first disc 35 and the second disc 36 are axially movable one with respect to the other between a first adjusting position and a second operating position.

In the first adjusting position, the first toothing 43 and the second toothing 52 are axially spaced away from each other so that the teeth 53 of the second toothing 52 do not even partially lie between the teeth 44 of the first toothing 43. In order to obtain this configuration, the ring nut 57 is partially or fully unscrewed. If the ring nut is fully unscrewed and e.g. removed from the central shaft 54, said central shaft 54 cannot however be fully taken out from the central through hole 40 (and the discs 35, 36 cannot be fully disconnected one from the other), since the retaining ring 59 integral with the first disc 35 abuts against the annular retaining surface 55 of the second disc 36. In this first adjusting position, the first disc 35 and the second disc 36 can be freely rotated one with respect to the other around the central axis "X-X".

In the second operating position, the ring nut 57 is fully screwed onto the central shaft 54 so as to tighten the first disc 35 against the second disc 36. The first toothing 43 and the second toothing 52 are mutually engaged (the teeth 53 of the second toothing 52 are between the teeth 44 of the first toothing 43) so that every relative rotation between the first disc 35 and the second disc 36 around the central axis "X-X" is prevented. When the discs 35, 36 are in the second operating position, the collecting assembly 2 is integral with the needle-holding element 5 and can rotate with said needle-holding element 5, being dragged by the latter. Once the ring nut 57 is unscrewed, either manually or using tools, the second disc 36 moves axially away from the first disc 35, under the effect of the weight of the collecting assembly 2, thus reaching the first adjusting position. In this first position it is possible to adjust the angular position of the collecting assembly 2 with respect to the needle-holding element 5 around the central axis "X-X", e.g. by manually acting upon said collecting assembly 2. Once the angular position is adjusted, the ring nut 57 is again screwed until the discs 35, 36 reach the second operating position.

The toothings 43, 52 of the discs 35, 36 just described above enable a discrete adjustment of the mutual angular position. The number of angular positions is a finite number related to the number of teeth 44, 53.

According to a variant of embodiment, not shown, of the adjusting devices 34, the first and the second disc 35, 36 do not have toothings but respective friction surfaces which, when tightened one against the other, prevent any relative rotation between the discs 35, 36. These friction surfaces are preferably made of composite materials including e.g. aramide, resin, ceramic, aluminum oxide, graphite, carbon. In this case, the number of angular positions is an infinite number (continuous adjustment).

According to further variants of embodiment, not shown, the discs 35, 36 (either with teeth or with friction materials) are moved axially (so as to move them closer or away from each other) and/or in rotation by means of motors.

According to a different embodiment, schematically shown in FIG. 13, the adjusting devices comprise a mechanical drive 34A (schematically shown as a box in FIG. 13), which can be actuated manually, e.g. by means of a crank, or can be motorized. The mechanical drive 34A can comprise e.g. a toothed gear connected to the collecting assembly 2, and a crown gear connected to the supporting frame 33, or a set of gears operatively placed between the collecting assembly 2 and the supporting frame 33. In this case again, the number of angular positions is an infinite number (continuous adjustment).

In one embodiment, schematically shown in FIG. 9 only, the assembly 2 is a take-down and collecting assembly and further comprises take-down elements 60 which cause the knitted fabric "T" to get down under tension into the collecting space. In the example shown, the take-down elements 60 comprise several take-down rolls, placed in series one to the other, acting upon the knitted fabric "T" so as to force the advancement thereof towards the collecting roll 27. FIG. 9 shows by way of example three take-down rolls 61, 62 ad 63, which are placed in series one to the other and which the knitted fabric "T" gets through sequentially. The take-down rolls 61, 62, 63 are placed, with respect to the direction of advancement of the knitted fabric "T", between the first spreading roll 30 and the second spreading roll 31. The collecting rolls 61, 62, 63 are turnably mounted onto the supporting structure 15 so as to freely rotate around respective axes of rotation which are basically rectilinear, horizontal and parallel to the collecting roll. Each one of the take-down rolls 61, 62, 63 extends between two of its longitudinal ends, on which it is turnably connected to the aforesaid side plates 17 and 18. The piling-up devices 20, the spreading devices 19 and the take-down elements 60 are integral with each other in the rotation around the central axis "X-X" (both during adjustment and during production).

The machine 1 further comprises an electronic control unit, not shown, for managing its operations.

In one embodiment in which the adjusting devices 34 are motorized, the electronic control unit is operatively connected to the motor or motors of said devices 34 and is configured for controlling the motor or motors based on input data related to the desired angular position of the collecting assembly 2. The operator can e.g. insert the desired angular value into the control unit by means of input devices (keyboard, touchscreen, mouse, etc.) and the control unit controls the motor so that it moves the collecting assembly accordingly. In a variant of embodiment, the electronic control unit is configured for receiving as input, instead of the desired angular value, a value related to the desired fabric height, such as the width of the dead zone or the number of active needles or the number of deactivated needles, and for controlling the motor or motors accordingly so that it moves/they move the collecting assembly accordingly.

In another variant of embodiment, the electronic control unit is operatively connected to the devices for varying the number of active needles and is configured for receiving as input a value related to the desired fabric height, for calculating the number of active needles required for obtaining this height, for controlling the devices for varying the number of active needles so that they activate the required needles, and for controlling the motor or motors so that it moves/they move the collecting assembly accordingly.

In another variant of embodiment in which the adjusting devices 34 are manual, the electronic control unit is operatively connected to the devices for varying the number of active needles and is configured for receiving as input a value related to the desired fabric height, for calculating the number of active needles required for obtaining this height, for controlling the devices for varying the number of active needles so that they activate the required needles, and for providing as output (e.g. on a screen) the angular position of the collecting assembly (which is then adjusted manually).

The collecting assembly 2, the adjusting devices 34 and the supporting frame 33 make a collecting set according to the present invention, which can be firmly connected to the knitting head of a circular machine, even if already existing (retrofitting).

In use and according to a method for adjusting the width of a knitted fabric "T" and with a process for producing a knitted fabric "T" according to the present invention, the machine 1 is preset for producing a knitted fabric "T" having a predefined height. To this purpose, the operator sets the width of the operating zone 10 (and thus of the dead zone 11) by activating or deactivating a given number of needles 6, 7. Then, by acting upon the adjusting devices 34 according to the above description, it adjust the angular position of the collecting assembly 2 accordingly, so as to angularly center the collecting assembly 2 with respect to the dead zone 11 (i.e. with respect to the operating zone 10). Starting from the situation shown in FIG. 11, in which all the needles 6 present are active and the plane of symmetry "P" of the collecting assembly 2 is centered with respect to the zone 11 without needles (and thus with respect to the operating zone 10 and to the knitted fabric "T" produced), the operator deactivates a plurality of needles 6 starting from the last needle **6*b* adjacent to the zone without needles 11 as far as the needle referred in FIG. 12 with numeral 6*b*'. The dead zone of FIG. 9 (made up of the zone without needles and of inactive needles) is thus wider than the one in FIG. 11. In order to center again the collecting assembly 2 with respect to the new dead zone 11, the operator rotates said collecting assembly 2** of an angle "Y". Now the operator can begin production.

The invention claimed is:

1. An open-type circular knitting machine for open and width-variable web production with a knitted fabric take-down and/or collecting assembly, the machine comprising:

a base;

a knitting head mounted onto the base, the knitting head including:

at least a needle-holding element having at least a plurality of needles arranged around a central axis;

a first active needle and a last active needle of the plurality of needles delimiting between the first active needle and the last active needle a dead zone of the needle-holding element without needles and/or without active needles, and an operating zone shaped as an arc of circle and provided with active needles; and a control means operatively connected at least to the active needles so as to selectively actuate the active needles in order to produce an open knitted fabric;

a take-down and/or collecting assembly for the knitted fabric under production, the take-down and/or collecting assembly being arranged downstream from the knitting head with respect to a feeding direction of the knitted fabric under production, the take-down and/or collecting assembly being integral with the needle-holding element during the production of the knitted fabric; and a plurality of adjusting devices configured to adjust an angular position of the take-down and/or collecting assembly with respect to the dead zone of the needle-holding element around the central axis.

2. The machine according to claim 1, wherein:

the take-down and/or collecting assembly is hung below the knitting head, and the adjusting devices are operatively placed between the take-down and/or collecting assembly and the knitting head.

3. The machine according to claim 1, wherein the adjusting devices are of a manual adjustment type or include at least a motor configured to move the take-down and/or collecting assembly with respect to the needle-holding element.

4. The machine according to claim 1, further comprising varying devices configured to vary a number of the active needles in the operating zone so as to adjust a height of the knitted fabric, wherein the adjusting devices include a control unit operatively connected to a motor configured to move the takedown and/or collecting assembly with respect to the needle-holding element, the control unit being configured to:

receive, as input, the number of active needles, calculate a correct position of the takedown and/or collecting assembly corresponding to the number of active needles, and provide, as output, the angular position of the take-down and/or collecting assembly, or control the motor and directly adjust the angular position.

5. The machine according to claim 1, wherein the adjusting devices include:

a first disc integral with the needle-holding element; and a second disc integral with the take-down and/or collecting assembly, wherein:

the first disc faces the second disc and is coaxial with the second disc, the first disc is engageable with the second disc in a plurality of angular positions, and the first disc is movable with respect to the second disc between a first adjustment position in which the first disc rotates with respect to the second disc, and a second operating position in which the first disc is integrally blocked to the second disc.

6. The machine according to claim 1, wherein the take-down and/or collecting assembly includes:

a plurality of spreading devices configured to open and stretch, in a single layer, the knitted fabric produced by the knitting head, the spreading devices including at least a spreading bar, or piling-up devices configured to pill up the knitted fabric stretched, the piling-up devices including at least a collecting roll; or a plurality of take-down elements for the knitted fabric produced, the plurality of take-down elements including at least a take-down roll.

7. A method for adjusting a width of a knitted fabric produced on an open-type circular knitting machine for open and width-variable production of a web with a knitted fabric take-down and/or collecting assembly, the method comprising steps of:

setting a width of a dead zone of a needle-holding element of the machine delimited by a first active needle and by a last active needle of at least a plurality of active needles arranged along an operating zone shaped as an arc of circle and developing around a central axis; and adjusting an angular position of the take-down and/or collecting assembly of the machine with respect to the dead zone.

8. The method according to claim 7, wherein adjusting the angular position includes rotating and then blocking the take-down and/or collecting assembly with respect to the needle-holding element and around the central axis.

9. The method according to claim 7, wherein adjusting the angular position includes angularly centering the take-down and/or collecting assembly of the machine with respect to the dead zone.

10. The method according to claim 7, wherein setting the width of the dead zone includes activating or deactivating at least a needle of the plurality of needles starting from the first active needle and/or from the last active needle.

* * * * *